US006471107B2

(12) United States Patent
Liu et al.

(10) Patent No.: US 6,471,107 B2
(45) Date of Patent: Oct. 29, 2002

(54) NAIL GUN WITH WASHER FEEDING DEVICE

(76) Inventors: Hsien Nung Liu, 12Fl., No. 100, Ming-Chuan Rd., Hsin-Tien, Taipei-Hien (TW); Chien Chi Chou, 12Fl., No. 100, Ming-Chuan Rd., Hsin-Tien, Taipei-Hien (TW)

( * ) Notice: Subject to any disclaimer, the term of this patent is extended or adjusted under 35 U.S.C. 154(b) by 0 days.

(21) Appl. No.: 09/819,485

(22) Filed: Mar. 27, 2001

(65) Prior Publication Data

US 2001/0052534 A1 Dec. 20, 2001

Related U.S. Application Data

(63) Continuation of application No. 09/628,240, filed on Jul. 28, 2000.

(30) Foreign Application Priority Data

Jun. 16, 2000 (TW) ..... 89203004 U

(51) Int. Cl.[7] ..... B25C 1/04

(52) U.S. Cl. ..... 227/18; 227/119; 227/120; 227/138

(58) Field of Search ..... 227/119, 18, 135, 227/136, 15, 107, 120, 138, 130; 206/445, 303; 221/197, 198, 297

(56) References Cited

U.S. PATENT DOCUMENTS

| | | | | | |
|---|---|---|---|---|---|
| 3,595,460 | A | * | 7/1971 | Pitkin | 227/130 |
| 5,056,684 | A | * | 10/1991 | Beach et al. | 221/197 |
| 5,163,580 | A | * | 11/1992 | Beach et al. | 206/445 |
| 5,634,583 | A | * | 6/1997 | McGuinness et al. | 227/138 |
| 5,673,816 | A | * | 10/1997 | Larson et al. | 221/197 |
| 5,791,546 | A | * | 8/1998 | McGuinness et al. | 227/119 |
| 6,065,660 | A | * | 5/2000 | Cabrera | 227/18 |
| 6,273,315 | B1 | * | 8/2001 | McGuinness et al. | 227/18 |

* cited by examiner

*Primary Examiner*—Scott A. Smith

(57) ABSTRACT

A washer feeding device attached to a nail gun is provided. The washer feeding device comprises a receiving cylinder having a plurality of washers stacked therein; a pneumatic delivery mechanism for pushing the bottommost washer in the receiving cylinder into the nail gun; a support mechanism secured to the delivery mechanism and the nail gun for mounting the receiving cylinder; and a bias mechanism put on the support mechanism being movable in the receiving cylinder, the bias mechanism including an upright, a spring put on the upright, and a disc secured to the upright. The disc is elastically biased against the topmost washer in the receiving cylinder.

8 Claims, 5 Drawing Sheets

NAIL GUN WITH WASHER FEEDING DEVICE

CROSS-REFERENCE TO RELATED APPLICATION

This is a continuation of application Ser. No. 09/628,240 filed on Jul. 28, 2000. The subject matter of the application is incorporated herein by reference.

FIELD OF THE INVENTION

The present invention relates to pneumatic nail guns and more particularly to a nail gun with washer feeding device.

BACKGROUND OF THE INVENTION

U.S. patent application Ser. No. 09/628,240 filed by the present applicant is aimed at providing an improved nail gun for enhancing the fixing capability of nail and washer combination. But now the applicant finds that above mentioned application may be further improved by providing a guide to the washer biasing spring. As a result, the spring is not susceptible to deformation and the operation of nail gun may be more smooth. The present application is thus provided to effect the improvement.

SUMMARY OF THE INVENTION

It is an object of the present invention to provide a nail gun with washer feeding device wherein a mechanism for guiding the washer biasing spring is provided in the receiving cylinder, resulting in a smooth operation.

To achieve the above and other objects, the present invention provides a washer feeding device attached to a nail gun, the washer feeding device comprising a receiving cylinder having a plurality of washers stacked therein; an pneumatic delivery mechanism for pushing the bottommost washer in the receiving cylinder into the nail gun; a support mechanism secured to the delivery mechanism and the nail gun for mounting the receiving cylinder; and a bias mechanism put on the support mechanism being movable in the receiving cylinder, the bias mechanism including an upright, a spring put on the upright, and a disc secured to the upright. The disc is elastically biased against the topmost washer in the receiving cylinder.

The above and other objects, features and advantages of the present invention will become apparent from the following detailed description taken with the accompanying drawings.

DETAILED DESCRIPTION OF THE PREFERRED EMBODIMENTS

Figure 1:
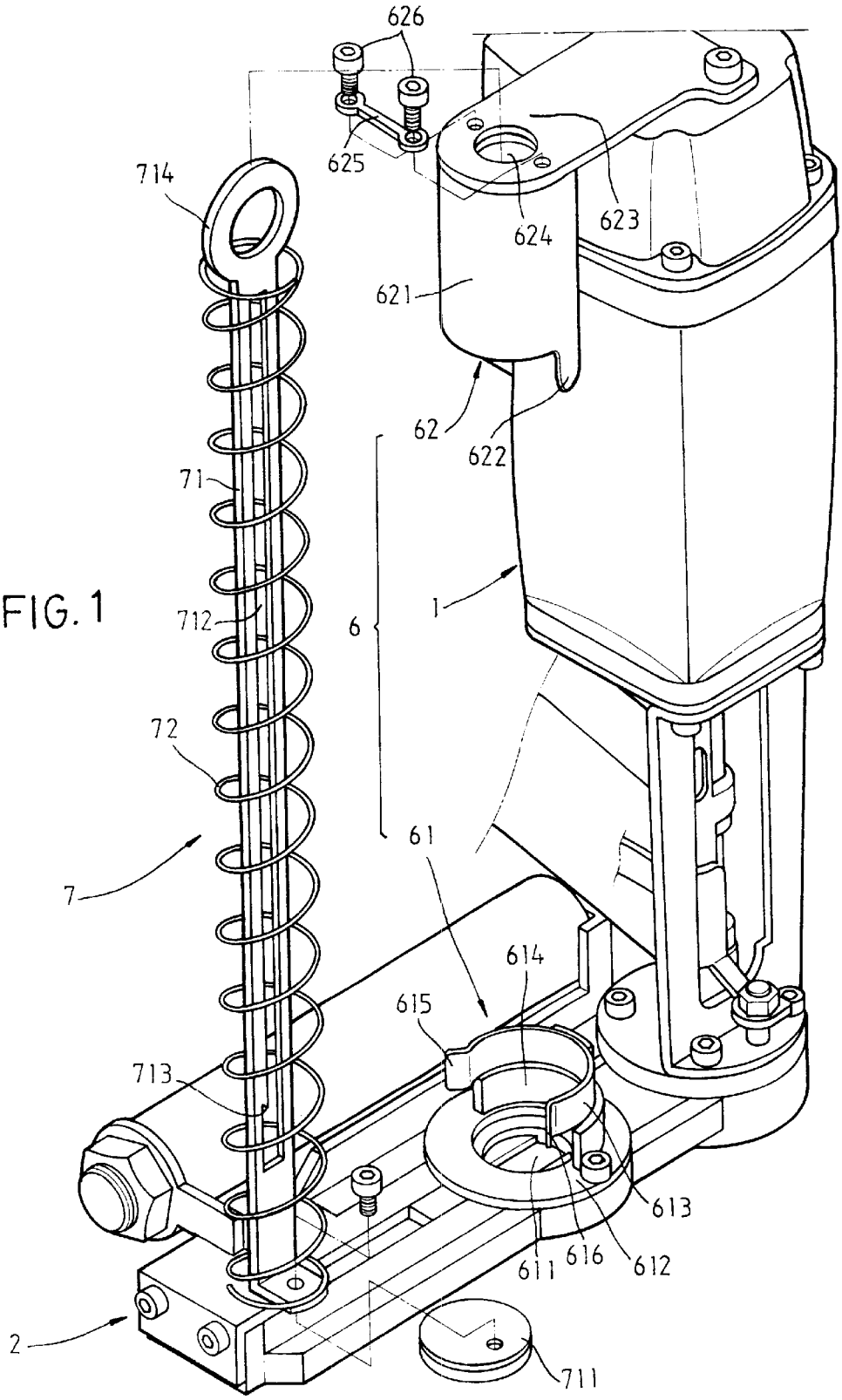
FIG. 1 is an exploded perspective view of a nail gun with washer feeding device according to the invention.
Figure 2:
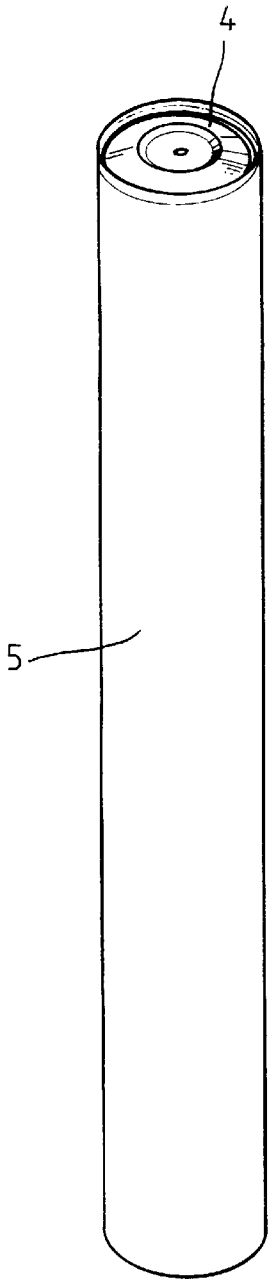
FIG. 2 is a perspective view of receiving cylinder of the nail gun shown in FIG. 1.
Figure 3:
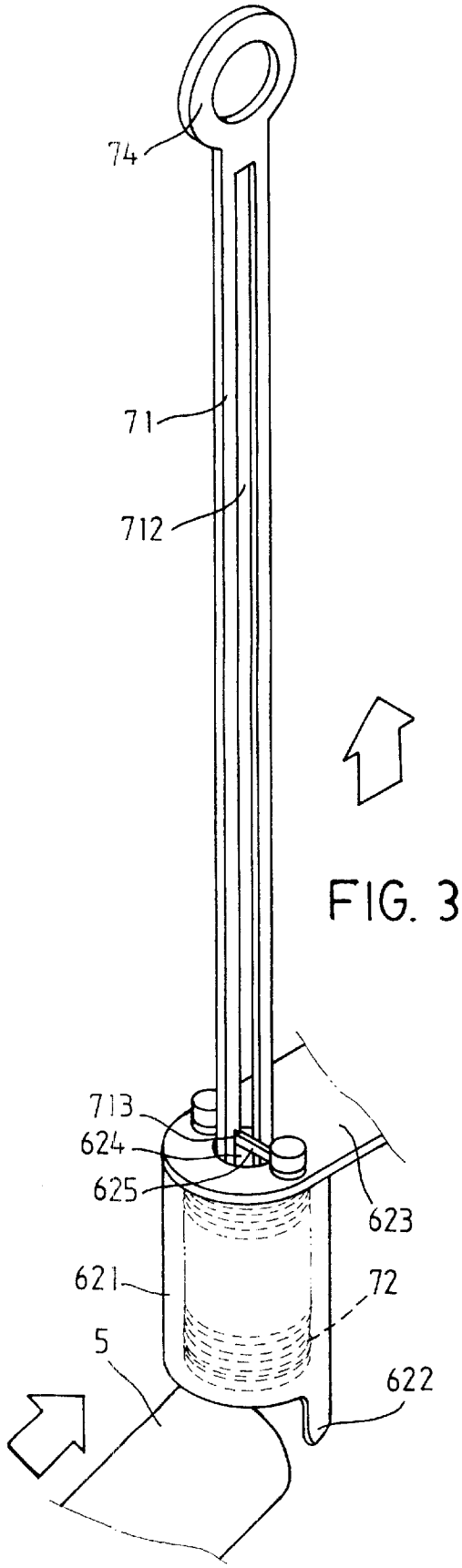
FIG. 3 is a perspective view illustrating how to mount receiving cylinder to washer receiving mechanism.
Figure 4:
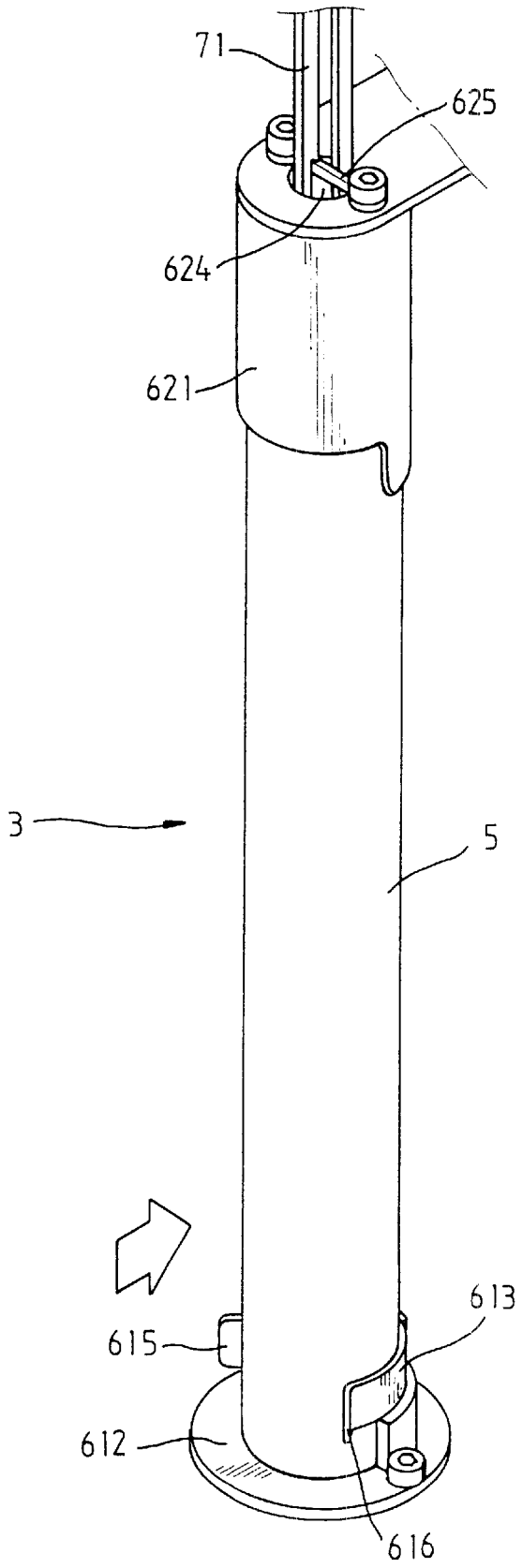
FIG. 4 is a perspective view showing a mounted receiving cylinder.

Referring to FIGS. 1 through 4, there is shown a nail gun 1 with washer feeding device in accordance with the invention. The washer feeding device is attached to a side of nail gun 1. A couple of major constituent components of the invention such as flat case like washer delivery mechanism 2 and nail gun 1 are the same as that of the prior U.S. patent application Ser. No. 09/628,240. Thus a detailed description thereof is omitted herein for the sake of brevity. Following is a description of a washer receiving mechanism 3 comprising the remaining components such as washer receiving cylinder 5, support mechanism 6 for mounting receiving cylinder 5, and bias mechanism 7 put on support mechanism 6.

Support mechanism 6 is comprised of a seat 61 secured to washer delivery mechanism 2 and a cap 62 secured to the top of nail gun 1. Washer receiving cylinder 5 is mounted between seat 61 and cap 62. Seat 61 comprises a ring 612 with a washer outlet 611 in the center and a half circular engagement member 613 adjacent a space 614 for receiving a portion of receiving cylinder 5. Either end 615 (or 616) of engagement member 613 is bent outwardly for facilitating the mounting of receiving cylinder 5. It is designed that the smallest distance between bent ends 615 and 616 is slightly smaller than the diameter of receiving cylinder 5. Hence, a clamping force is exerted on the receiving cylinder 5 by the engagement member 613 after receiving cylinder 5 is mounted in support mechanism 6. Cap 62 comprises a hollow cylindrical member 621 having an inner diameter slightly larger than the diameter of receiving cylinder 5 so as to permit the top of receiving cylinder 5 to insert therein, a guide 622 at the bottom of cylindrical member 621 for facilitating the mounting of receiving cylinder 5, an extended bracket 623 at the top having a hole 624, and an elongate abutment member 625 having two end holes such that two bolts 626 may threadedly secure abutment member 625, bracket 623, and cylindrical member 621 together. The other end of bracket 623 is also threadedly secured to the top of nail gun 1.

Bias mechanism 7 comprises an upright 71 and a helical spring 72 put on upright 71. The width of upright 71 is smaller than the hole 624 such that upright 71 may be inserted through the hole 624. The diameter of spring 72 is larger than that of the hole 624. Hence, spring 72 is biased between the underside of bracket 623 and the bent portion at the bottom of upright 71 after receiving cylinder 5 mounted. The bent portion of upright 71 is threadedly secured to a planar disc 711 which is biased against the topmost washer 4 of a washer stack in receiving cylinder 5. An elongate slot 712 is formed in upright 71. A lateral latch 713 is formed near the bottom end of slot 712. A ring 714 is formed at the top of upright 71. The diameter of the ring 714 is larger than that of the hole 624. Hence, the ring 714 is kept at the outside of bracket 623.

In assembly the bias mechanism 7 and the support mechanism 6, first loosen the abutment member 625. Then insert the bottom of upright 71 through the hole 624. Next put spring 72 on upright 71. Then threadedly secure disc 711 to the bottom of upright 71. Then insert abutment member 625 through slot 712 and secure abutment member 625 to the bracket 623. Then pull ring 714 to cause abutment member 625 to slide downwardly along slot 712 as well as lift upright 71 and disc 711 until upright 71 is secured by engaging abutment member 625 with latch 713. At this time, spring 72 is completely compressed in the cylindrical member 621. Next slantly mount the receiving cylinder 5 to the cylindrical member 621 with the guidance of the guide 622. Also, the bottom of receiving cylinder 5 is pushed onto the seat 61 of support mechanism 6, i.e., held in the space 614. Then disengage latch 713 from abutment member 625 to cause disc 711 at the underside of upright 71 to be biased by the compression of spring 72. Thus, once the bottommost washer 4 has been pushed toward the nail outlet by the washer delivery mechanism 2 resulting in a reduction of compression of spring 72, spring 72 is immediately expanded to push the next washer 4 to be the bottommost washer 4. At the same time, upright 71 is lowered. With such configuration, spring 72 is not susceptible to deformation and the operation of nail gun 1 is more smooth.

Figure 5:
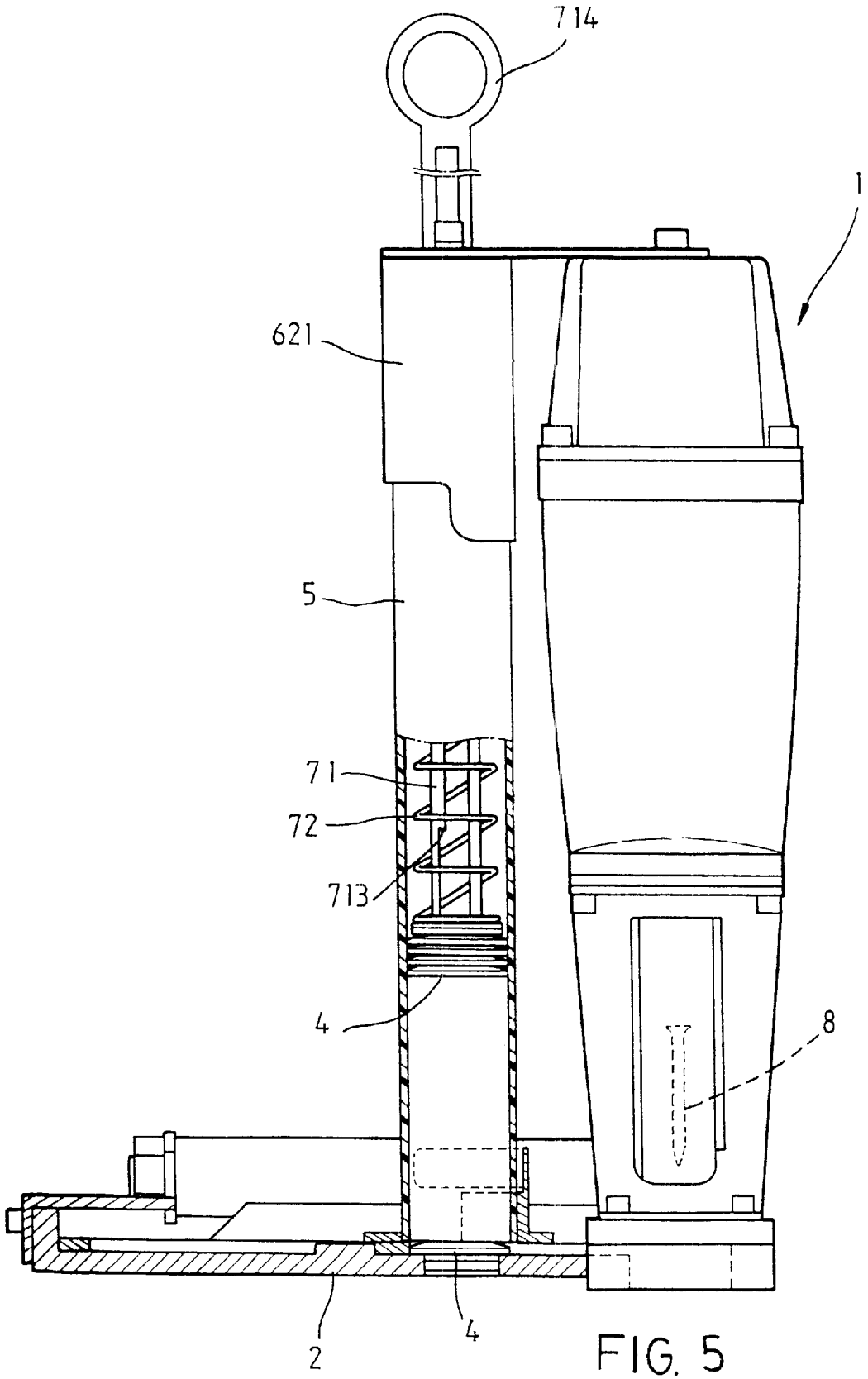
FIG. 5 is a side schematic partially broken away view where washer in the receiving cylinder is dropped on the delivery mechanism.
Figure 6:
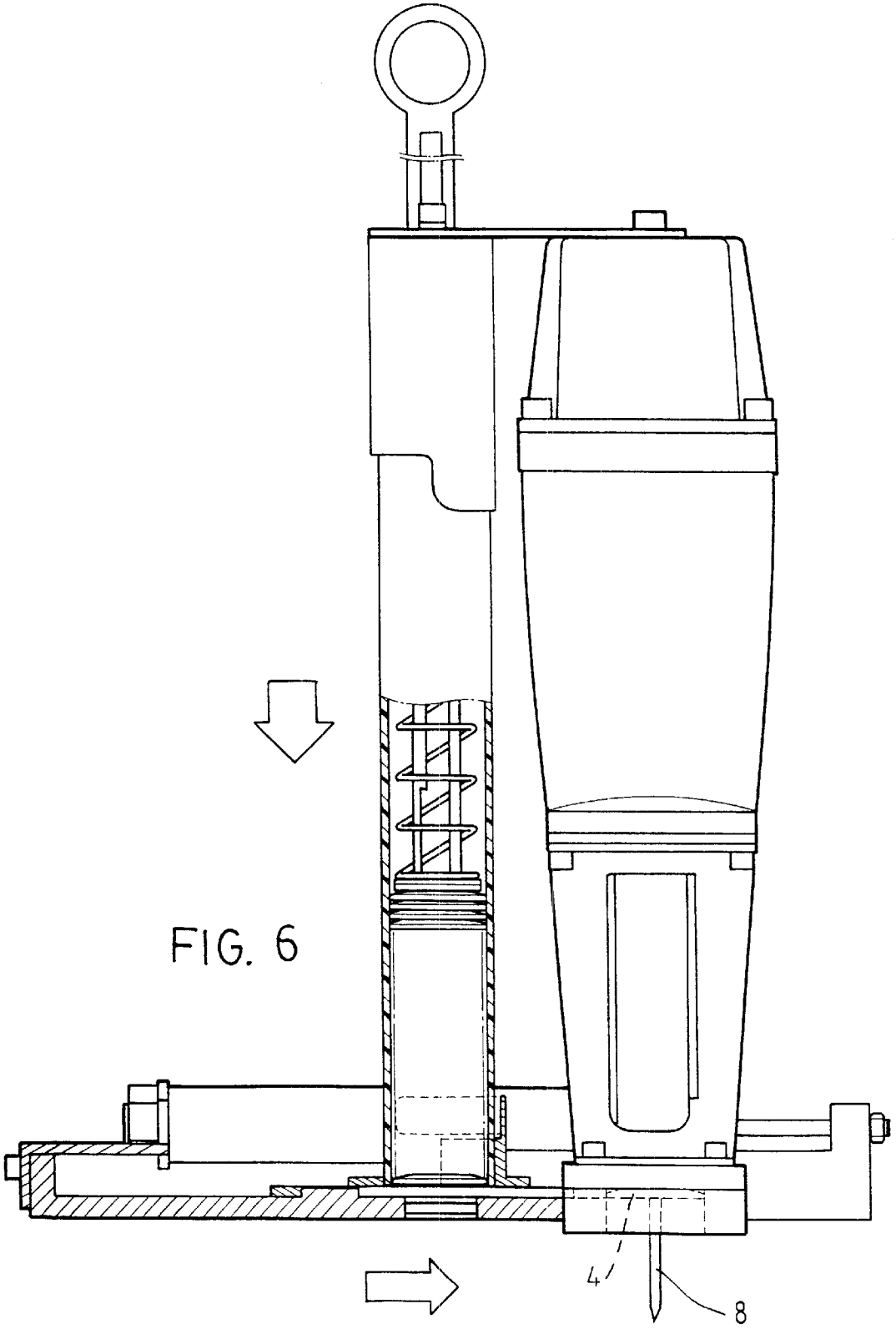
FIG. 6 is similar to FIG. 5 where washer is pushed to nail outlet and is penetrated by nail.

Referring to FIGS. 5 and 6, the operation of the invention will now be described. When pneumatic nail gun 1 is activated, nail 8 is continuously cast out of nail gun 1 wherein the tip of nail 8 passes through washer 4. Thus, a desired object may be fixed to the other by the cast nail 8 and washer 4.

While the invention has been described by means of specific embodiments, numerous modifications and variations could be made thereto by those skilled in the art without departing from the scope and spirit of the invention set forth in the claims.

What is claimed is:

1. A washer feeding device attached to a nail gun, said washer feeding device comprising:

a receiving cylinder having a plurality of washers stacked therein;

a pneumatic delivery mechanism for pushing a bottommost washer in said receiving cylinder into said nail gun;

a support mechanism secured to said delivery mechanism and said nail gun for mounting said receiving cylinder; and a bias mechanism put on said support mechanism being movable in said receiving cylinder, said bias mechanism including an upright, a spring on said upright, and a disc secured to said upright;

wherein said disc is biased against a topmost washer in said receiving cylinder; and wherein said support mechanism comprises a seat secured to said delivery mechanism and a cap secured to said nail gun such that said receiving cylinder is mountable between said seat and said cap.

2. The washer feeding device of claim 1, wherein said seat comprises a ring with a washer outlet, a half circular engagement member, and a space adjacent said engagement member for receiving a portion of said receiving cylinder; and said cap comprises a hollow cylindrical member having an inner diameter slightly larger than a diameter of said receiving cylinder so as to receive a top of said receiving cylinder.

3. The washer feeding device of claim 2, wherein an outwardly bent portion is formed at ends of said engagement member for facilitating said mounting of said receiving cylinder and a smallest distance between said bent portions is smaller than said diameter of said receiving cylinder such that a clamping force is generated and exerted on said receiving cylinder by said engagement member after said receiving cylinder is mounted in said support mechanism.

4. The washer feeding device of claim 1, wherein said cap further comprises an extended bracket at a top having one end secured to a top of said nail gun, a hole through said bracket, and an elongate abutment member having two end apertures such that said abutment member, said bracket, and said cylindrical member are threadedly secured together by a plurality of fasteners through said apertures.

5. The washer feeding device of claim 4, wherein a width of said upright is smaller than said hole such that said upright is inserted through said hole and a diameter of said spring is larger than that of said hole such that said spring is biased between an underside of said bracket and a bent portion of said upright after said receiving cylinder is mounted.

6. The washer feeding device of claim 5, further comprising an elongate slot in said upright and a lateral latch on an edge of said slot adjacent a said bottom end thereof.

7. The washer feeding device of claim 6, further comprising a ring at a top of said upright wherein a diameter of said ring is larger than that of said hole so as to keep said ring at an outside of said bracket.

8. The washer feeding device of claim 2, wherein said cap further comprises a guide at a bottom of said cylindrical member for facilitating mounting of said receiving cylinder.

* * * * *